US005553651A

United States Patent [19]

Olsen

[11] Patent Number: 5,553,651

[45] Date of Patent: Sep. 10, 1996

[54] INTERCONNECTING ELEMENT FOR CONNECTING PANELS

[76] Inventor: Bjørn W. Olsen, Kjøpmannsvik, N-4770 Høvåg, Norway

[21] Appl. No.: 392,883

[22] PCT Filed: Aug. 31, 1993

[86] PCT No.: PCT/NO93/00131

§ 371 Date: Apr. 6, 1995

§ 102(e) Date: Apr. 6, 1995

[87] PCT Pub. No.: WO94/05887

PCT Pub. Date: Mar. 17, 1994

[30] Foreign Application Priority Data

Sep. 1, 1992 [NO] Norway ..... 923416

[51] Int. Cl.[6] ..... E06B 3/12

[52] U.S. Cl. ..... 160/235

[58] Field of Search ..... 160/235, 201, 160/229.1, 196.1, 199, 206, 232, 236

[56] References Cited

U.S. PATENT DOCUMENTS

| | | | |
|---|---|---|---|
| 2,880,796 | 4/1959 | Stroup | 160/201 X |
| 3,067,814 | 12/1962 | Anthony . | |
| 3,247,637 | 4/1966 | Robertson | 160/201 |
| 3,511,301 | 5/1970 | Graham et al. | 160/235 X |
| 4,532,973 | 8/1985 | DeFalco | 160/235 |
| 4,924,932 | 5/1990 | Esnault | 160/235 X |

FOREIGN PATENT DOCUMENTS

| | | |
|---|---|---|
| 0326131 | 8/1989 | European Pat. Off. . |
| 0370324 | 5/1990 | European Pat. Off. . |
| 1310605 | 10/1961 | France . |
| 169357 | 7/1988 | Norway . |
| 883479 | 8/1988 | Norway . |
| 894620 | 11/1989 | Norway . |

*Primary Examiner*—David M. Purol

*Attorney, Agent, or Firm*—Jacobson, Price, Holman & Stern, PLLC

[57] ABSTRACT

An interconnecting element for connecting panels (2,23) consisting of upper (1) and lower (18) profile parts, the profile parts (1,18) having curved sections (5,20) which interact with each other at a distance from a pivotal joint (3). One side edge of the curved section (5) is intended to interact with the panel (2), and the other, opposite side edge is designed with a flange (4) which is at an angle to the pivotal joint (3) , which constitutes a rotation point for the curved section (5). Moreover the lower profile part (18) has a socket (19) for interaction with the pivotal joint (3), the curved section (20) being provided at a distance from the socket (19 ) for interaction with the upper profile part's curved section (5). The curved sections (5,20) are provided on the inside of the panels (2,23) on the end edges as an extension of the panels' (2,23) end profiles (10,30).

7 Claims, 4 Drawing Sheets

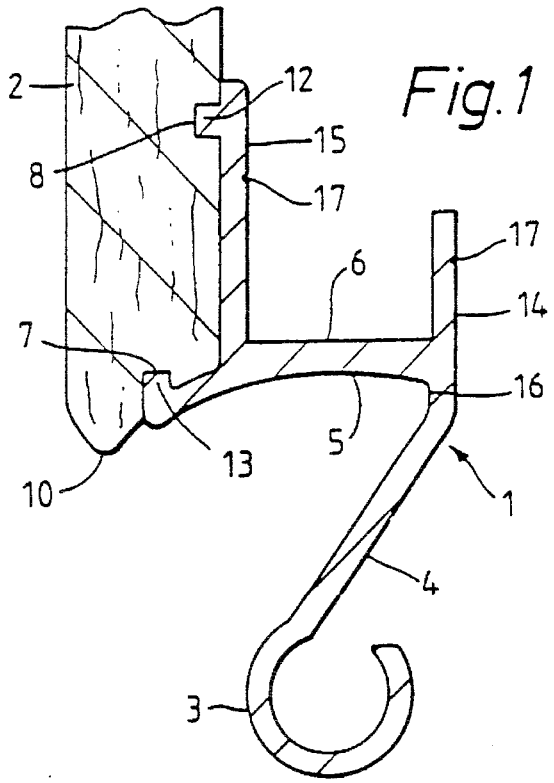
Fig. 1
Fig. 2
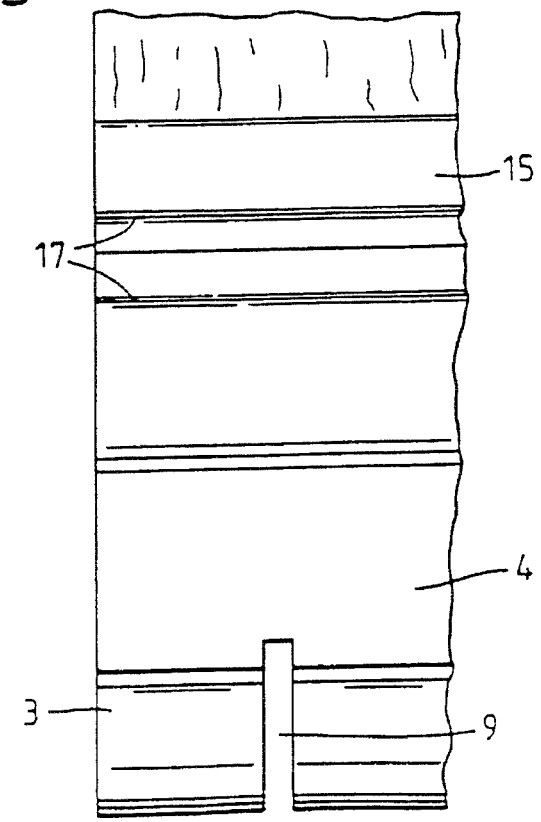

INTERCONNECTING ELEMENT FOR CONNECTING PANELS

BACKGROUND OF THE INVENTION

The invention concerns an interconnecting element, especially for connecting panels, e.g. of wood, metal or plastic, consisting of an upper profile part and a lower profile part, the profile parts having curved sections which interact with one another at a distance from a pivotal joint provided on the inside of the panels and which constitutes a rotation point for the curved section, that the lower profile part has a socket, which interacts with the pivotal joint, the curved section being provided at a distance from the socket for interaction with the curved section of the upper profile part.

At present there are many different types of panels known and in use in which horizontal panel sections are connected by means of articulated linkages in the form of interconnecting elements, e.g. for garage doors, etc. The most common kind of wooden doors are panel doors. Constructions of this kind require relatively thick panels, which give relatively heavy constructions, resulting in high material costs. Thick wooden panels also increase the likelihood of warping of the wood, which in turn can lead to leaks in the section connections and possibly jamming of the panels in the opening and closing positions. If the hinge elements are visible from the outside, this will impair the general appearance, especially in the case of wooden doors. Some hinge elements require, amongst other things, an external stop strip in the gap between the panels, in order to prevent contact between the panels' curved sections in the closed position. Moreover, due to the panel design in some connecting panels, it may be necessary to have a packing in the gap between the door leaves.

The above-mentioned disadvantages are covered by the following patent publications amongst others.

In NO 169 357 there is described a horizontally divided closing panel of polycarbonate which is equipped with unbroken horizontal hinge joints which can be engaged with one another by means of hooks and where the panels can be insulated on the inside. The pulley bolts are inserted into bushings which are forced into the hinge elements. The hinge joint is visible from the outside.

Further in EP 1 326 131 and NO patent application 88 3479 there is described another interconnecting element where the pivotal joint is drawn back from the gap between the panels and where there is no opening between two succeeding panels into which fingers can be inserted. The interconnecting elements cannot be pre-mounted on the panels in the factory. Further in FR 1 310 605 there is described an interconnecting element which also has a drawn back pivotal joint. These interconnecting elements generally consist of traditional hinge joints which are attached to the back of the panels.

From U.S. application Ser. No. 3 067 814 it is known a panel for incorporation in a seriatim assembly of such panels hingeably connected together. Said panel being constituted by a pair of mutually opposed first and second shields angularly disposed to one another. The first shield of each panel is provided with a curved portion and a projecting extension, parallel with a main body that integrally connects the shields and terminates in an axle housing located between the first and second shield.

SUMMARY OF THE INVENTION

The object of the invention is to provide an interconnecting element especially for connecting panels, which reduces the panel thickness without weakening the construction. A further object is to provide an interconnecting element which prevents the occurrence of any openings, which are large enough to allow fingers to be inserted and pinched, over the entire contact surface between the panels. A further object is that it should be easy to attach the interconnecting element to the panels and that the subsequent assembly of the panels and mounting of pulley bolts provides a stable construction, thus eliminating the possibility of mistakes occurring during assembly. Yet a further object is that the panels should be able to be insulated from the inside.

Thus it can be said that it is desirable to provide an interconnecting element for wooden panels consisting of two profiles which can be attached by means of hooks, which profiles are not visible from the outside and which are designed in such a way that the panel thickness can be reduced in relation to existing solutions.

This object is achieved by an interconnecting element which is characterized by those features and advantages which are indicated in the attached claims.

Thin panels assembled by means of an interconnecting element according to the invention will reduce the risk of warping of the wood. Furthermore the mounting of interconnecting elements on the panels will eliminate the possibility of mistakes occurring during assembly and reduce the installation time on the building site, the hinge profiles having ribs which match tracks in the panels and direction-indicating tracks being provided which mark attaching points for screws for mounting interconnecting elements to the panels. At the same time this is combined with known per se advantages such as recessed hinge joints, insulation capability and a safeguard against the likelihood of fingers being pinched.

The invention will now be described in more detail by means of an embodiment which is illustrated by means of the drawing.

BRIEF DESCRIPTION OF THE DRAWINGS

FIG. 1 is a schematic sectional view of an upper profile part according to the invention.

FIG. 2 is a schematic top view according to FIG. 1.

DESCRIPTION OF THE PREFERRED EMBODIMENTS

Figure 3:
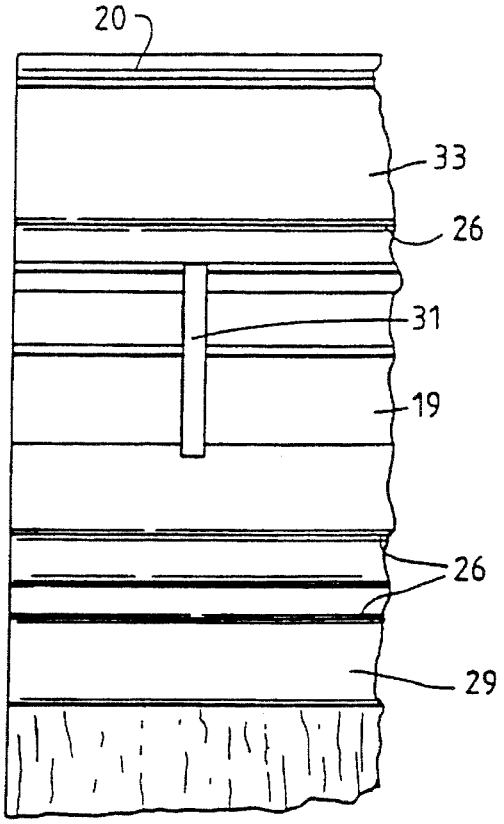
FIG. 3 is a schematic top view of a lower profile part according to the invention.

An embodiment of the device will now be described with reference numbers in accordance with the drawing. The invention is not limited to the following embodiment, but can also apply to metal and plastic designs.

FIGS. 1 and 2 illustrate an upper profile part 1 of an interconnecting element according to the invention, with a curved section 5, one end of which is intended to interact with a panel 2, and where the other, opposite side edge is designed with a flange 4 which is at an angle to a pivotal joint 3. The pivotal joint 3 forms a rotation point for the curved section 5 on interaction with a lower profile part 18. Furthermore there is provided a track 9 on the pivotal joint, perpendicular to the curved section 5. An upper panel 2 connected to the first profile part 1 has two tracks 7 and 8 and a tapering section 10, which is aligned with and forms an extension of the curved section 5. On the upper profile part 1 abutting against the upper panel 2 on the section facing the upper panel 2 there are provided two ribs 12 and 13 which interact with the panel tracks 7 and 8, and a direction-indicating track 17 for screwing the upper profile 1 on to the upper panel 2. In the transition between the curved section 5 and the flange 4 there is provided a contact surface 16. There is further provided a track 6 between two parallel flanges 14 and 15 which are aligned in the opposite direction in relation to the pivotal joint 3, for the installation of any insulation (not shown) and/or a stile for panelled doors, see FIG. 7.

Figure 4:
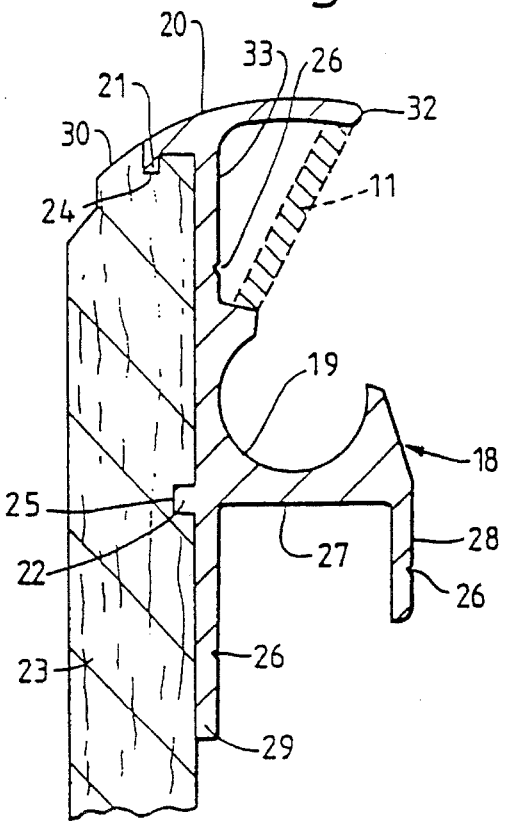
FIG. 4 is a schematic sectional view according to FIG. 3.

FIGS. 3 and 4 illustrate a lower profile part 18 of the interconnecting element according to the invention with a socket 19 which interacts with the pivotal joint 3, and with a curved section 20 provided at a distance from the socket 19, for interaction with the upper profile part's 1 curved section 5. A free end 32 of the curved section 20, in contact with the surface 16, constitutes the greatest possible deflection in a rotational direction. Between the curved section 20 and the hinged joint 19 there is provided a profile connection 33, which is parallel with the panel surface or angle flange 4 on the first profile part 1. An alternative design, projecting from the side edge of the socket 19 facing the panels 2, 23 to the free end 32, is indicated by reference number 11. The panel 23 has an endpiece 30, which is in alignment with and forms the extension of the curved section 20. In the same way as for the upper profile part 1, there are provided on the lower profile part 18 ribs 21 and 22 which interact with the lower panel's 23 tracks 24 and 25, a direction-indicating track 26 and between two flanges 28, 29 there is a track 27 for the installation of possible insulation and/or a stile for panelled doors.

Figure 5:
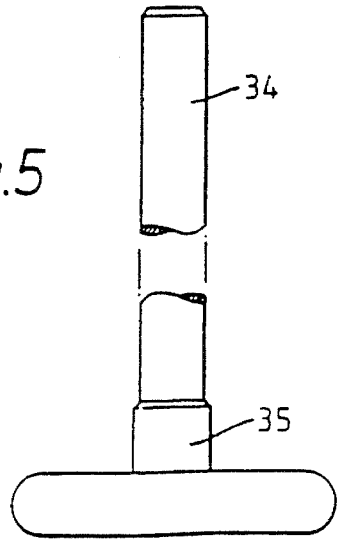
FIG. 5 is a schematic sectional view of a pulley bolt according to the invention.

FIG. 5 illustrates a pulley bolt 34 with a collar 35 which limits how far the pulley bolt 34 can be inserted into the pivotal joint 3. When the panels with their respective interconnecting elements are hooked together, a disc 36 (not shown) is placed in the tracks 9 and 31, thereby impeding a relative horizontal movement of the sections. Thereafter the pulley bolt 34 is inserted into the pivotal joint 3.

Figure 6:
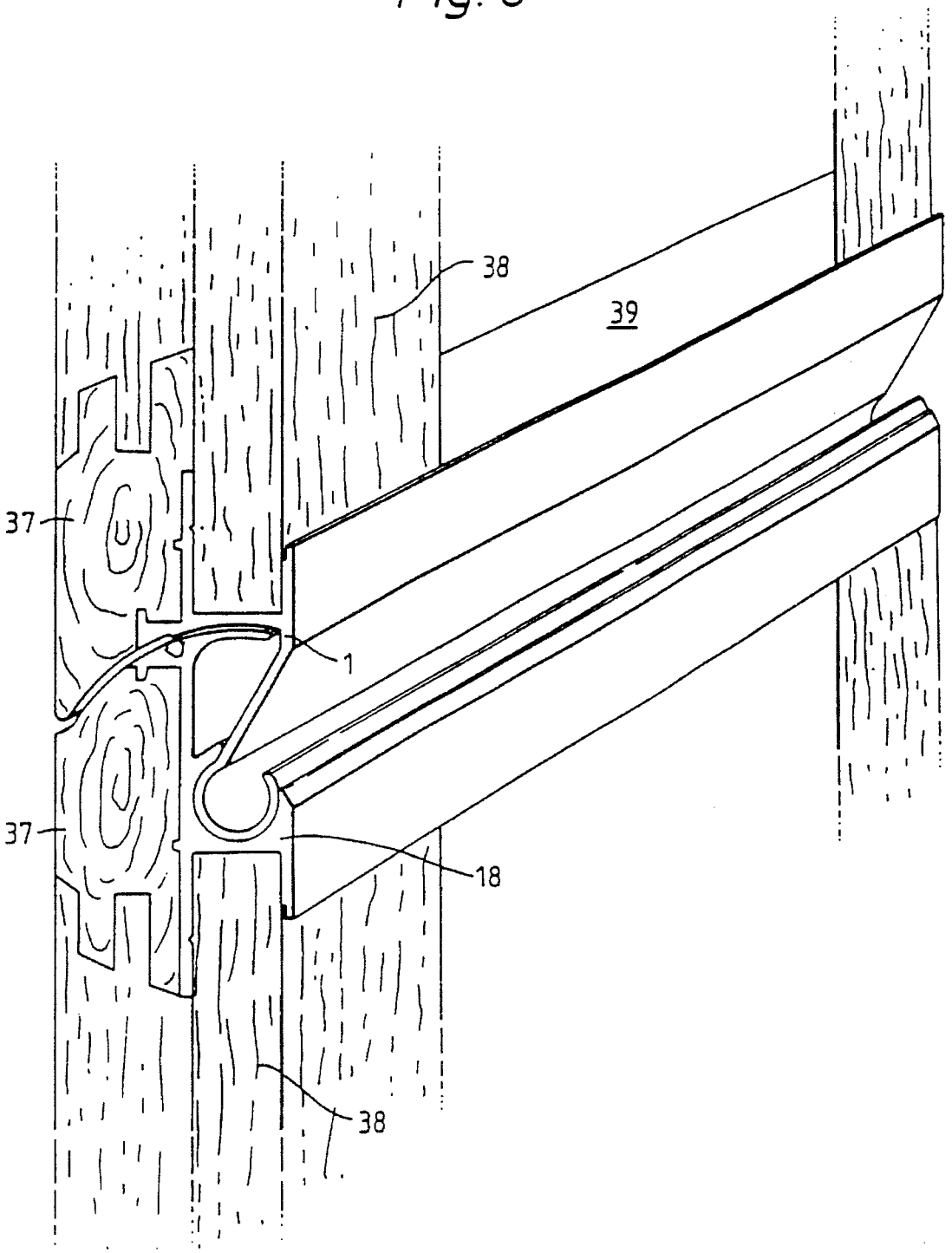
FIG. 6 is a perspective view of an embodiment according to the invention.

FIG. 6 shows an embodiment of a panel door 37 with stile 38 and possibly insulation 39 according to the invention.

Figure 7:
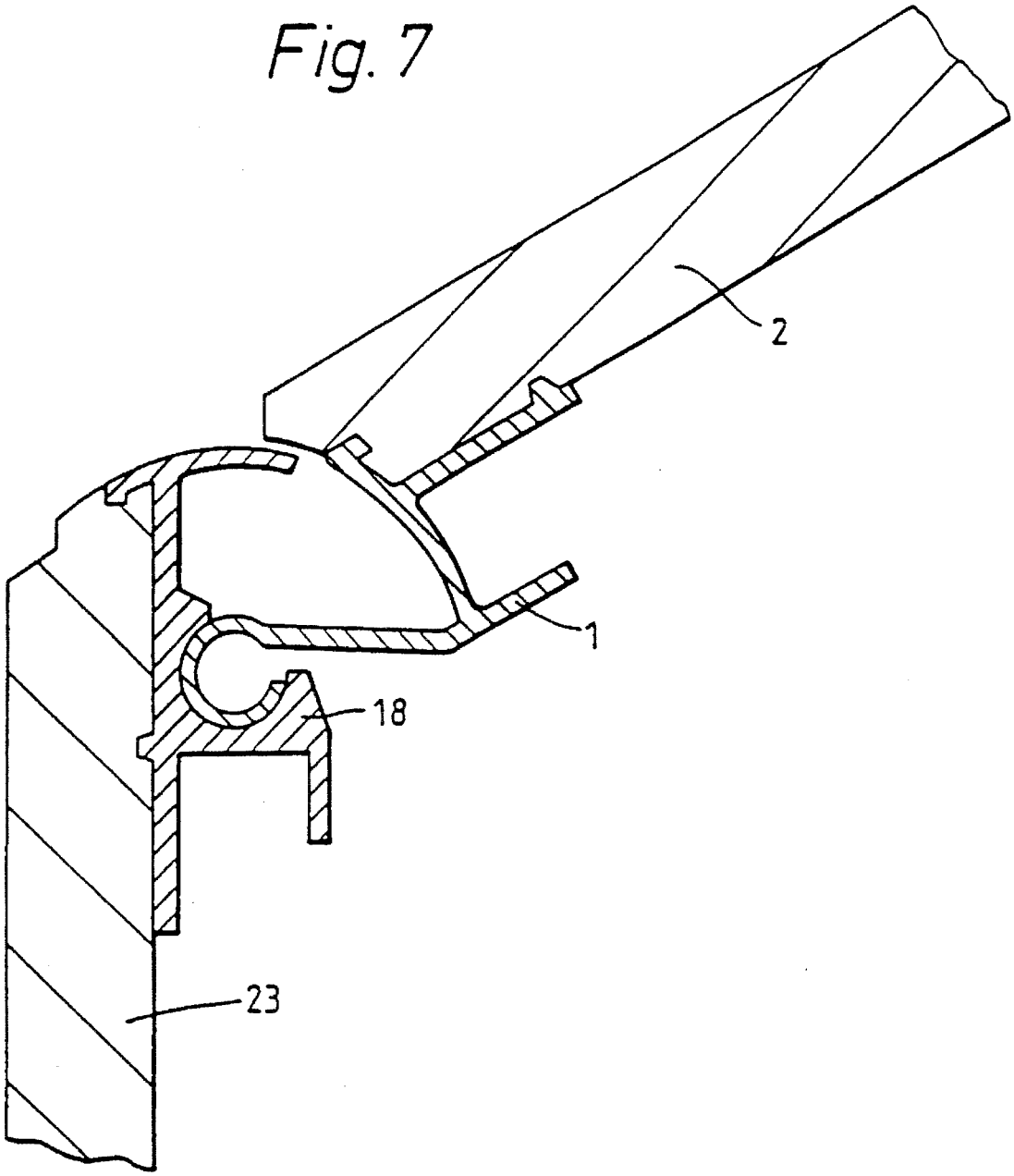
FIG. 7 is a schematic side view of an embodiment according to the invention.

FIG. 7 illustrates an embodiment of the first panel 2 and the second panel 23 according to the invention, with the greatest possible angular deflection to which the panels 2, 23 are exposed in the transition between the closing and opening positions. The transition between the above-mentioned closing and opening positions takes place gradually in two stages, where the maximum angular deflection in each stage is approximately 45 degrees.

The above-mentioned embodiment will provide substantial gains in efficiency since both the interconnecting elements and the panels can be mass-produced separately. This can be achieved because the interconnecting elements can easily be manufactured from, e.g. extruded aluminium profiles and, as a result of the invention, the panels will require less material than they do to-day. Moreover the invention ensures a simple, fast and accurate assembly at the building site, since the interconnecting elements are pre-mounted on the panels from the factory. Consequently a good and uniform quality is obtained for the final product, e.g. garage doors and the like.

I claim:

1. A device for interconnecting first and second panels, said device comprising an upper profile part and a lower profile part, the profile parts having respective curved sections which slidably interact with each other at a distance from a pivotal joint provided on the inside of the first and second panels and which constitutes a rotation point about which the curved section of the upper profile part is rotatable, said lower profile part having a socket which receives the pivotal joint in such a way that the pivotal joint is rotatable with respect to the socket, the curved section of the lower profile part being arranged at a distance from the socket for sliding interaction with the curved section of the upper profile part, wherein one side edge of the curved section of the upper profile part is connectable to the first panel and the other, opposite side edge includes a flange which extends at an angle to the pivotal joint and wherein the curved sections are located at an inside of the panels on end edges thereof as an extension of end profiles of the panels.

2. The device according to claim 1, wherein a profile connection to the curved section of the lower profile part is parallel with a surface of the second panel.

3. The device according to claim 1, wherein a profile connection to the curved section of the lower profile part is parallel with the flange of the first profile part.

4. The device according to claim 1, wherein the profile parts further include ribs for engagement with the panels, and wherein the ribs are perpendicular to additional flanges which extend in a direction opposite from the pivotal point.

5. The device according to claim 4, wherein the ribs are provided on the side edges of the curved sections which are facing the panels.

6. The device according to claim 1, wherein the pivotal joint includes at least one opening and the socket includes a track.

7. The device according to claim 1, wherein the profile parts include direction-indicating tracks.

* * * * *